US010737132B2

(12) United States Patent
Gangemi et al.

(10) Patent No.: US 10,737,132 B2
(45) **Date of Patent: *Aug. 11, 2020**

(54) BARBELL COLLAR

(71) Applicant: VENICE GRAVITY WORX, INC., Venice, CA (US)

(72) Inventors: Carmine Gangemi, Manhattan Beach, CA (US); Alberto Bevacqua, Venice, CA (US)

(73) Assignee: VENICE GRAVITY WORX, INC., Venice, CA (US)

( * ) Notice: Subject to any disclaimer, the term of this patent is extended or adjusted under 35 U.S.C. 154(b) by 78 days.

This patent is subject to a terminal disclaimer.

(21) Appl. No.: 16/179,772

(22) Filed: Nov. 2, 2018

(65) Prior Publication Data

US 2019/0070451 A1 Mar. 7, 2019

Related U.S. Application Data

(63) Continuation of application No. 16/011,391, filed on Jun. 18, 2018, now Pat. No. 10,166,430, which is a continuation-in-part of application No. 14/760,333, filed as application No. PCT/US2014/050003 on Aug. 6, 2014, now Pat. No. 10,022,582.

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0728* (2013.01)

(58) Field of Classification Search
CPC ..... A63B 21/072–075; A63B 21/4043; A63B 24/0075
USPC ..... D21/681–682
See application file for complete search history.

(56) References Cited

U.S. PATENT DOCUMENTS 4,231,569 A * 11/1980 Rae ..... A63B 23/1281 482/108
4,252,316 A * 2/1981 Price ..... A63B 21/0728 482/106
4,312,506 A * 1/1982 Brennan ..... A63B 21/0724 482/106
4,880,229 A * 11/1989 Broussard ..... A63B 21/0724 482/108
4,900,015 A * 2/1990 Dissinger ..... A63B 23/03533 482/121
5,284,463 A * 2/1994 Shields ..... A63B 21/0728 482/107
5,344,375 A * 9/1994 Cooper ..... A63B 21/0728 482/106
5,529,550 A * 6/1996 Maycock, Jr. ..... A63B 21/0552 482/132

(Continued)

*Primary Examiner* — Jennifer Robertson
(74) *Attorney, Agent, or Firm* — Kevin Schraven; Anooj Patel; Hankin Patent Law, APC.

(57) ABSTRACT

A barbell collar. The barbell collar may have a plate and at least two weight bars, a first weight bar and a second weight bar. The plate may comprise a barbell engagement portion, a heavy arm and a light arm. The heavy arm weighs more than said light arm. The barbell engagement portion is configured to engage with a barbell. Each of the at least two weight bars may be attached to each of the at least two arm portions of the plate. The at least two weight bars may be adapted to engage and hold one or more weights.

13 Claims, 12 Drawing Sheets

(56) References Cited

U.S. PATENT DOCUMENTS

| | | | | | |
|---|---|---|---|---|---|
| 5,573,484 | A * | 11/1996 | Carpenter | A63B 21/00181 | 482/108 |
| 5,752,903 | A * | 5/1998 | Chang | A63B 21/00047 | 482/140 |
| 7,201,711 | B2 * | 4/2007 | Towley, III | A63B 21/0605 | 482/106 |
| D554,209 | S * | 10/2007 | Loucks | D21/691 | |
| 7,311,641 | B2 * | 12/2007 | Panagos | A63B 21/072 | 482/106 |
| D633,961 | S * | 3/2011 | Loew | D21/679 | |
| 8,033,964 | B1 * | 10/2011 | Chen | A63B 21/00069 | 482/106 |
| 8,047,975 | B1 * | 11/2011 | Chen | A63B 21/22 | 482/104 |
| 8,574,136 | B1 * | 11/2013 | Burstrom | A63B 69/0057 | 482/108 |
| D734,407 | S * | 7/2015 | Gangemi | D21/680 | |
| D764,607 | S * | 8/2016 | Beckford | D21/679 | |
| 2006/0105890 | A1 * | 5/2006 | Logue | A63B 21/0724 | 482/106 |
| 2010/0087297 | A1 * | 4/2010 | Kanaoka | A63B 21/0726 | 482/108 |
| 2014/0018214 | A1 * | 1/2014 | Jordan | A63B 21/072 | 482/107 |
| 2014/0094347 | A1 * | 4/2014 | Orakwusi | A63B 21/1636 | 482/38 |
| 2014/0187392 | A1 * | 7/2014 | Renk | A63B 21/072 | 482/106 |
| 2019/0001178 | A1 * | 1/2019 | Wang | A63B 21/4049 | |

* cited by examiner

BARBELL COLLAR

CROSS-REFERENCE TO RELATED APPLICATIONS

This patent application is a Continuation of U.S. National Stage Utility Non-Provisional patent application Ser. No. 16/011,391, filed on Jun. 18, 2018, titled "BARBELL COLLAR", now U.S. Pat. No. 16,166,430 by co-inventors Carmine Gangemi and Alberto Bevacqua, the contents of which are hereby expressly incorporated by this reference in their entirety, and to which priority is claimed. U.S. patent application Ser. No. 16/011,391 is a Continuation-in-Part of U.S. National Stage Utility Non-Provisional patent application Ser. No. 14/760,333, filed on Jul. 10, 2015, titled "BARBELL COLLAR AND BARBELL SYSTEM", now U.S. Pat. No. 10,022,582, by co-inventors Carmine Gangemi and Alberto Bevacqua, the contents of which are hereby expressly incorporated by this reference in their entirety, and to which priority is claimed. U.S. National Stage Utility Non-Provisional patent application Ser. No. 14/760,333 is a 371 of International PCT Patent Application No. PCT/US2014/050003, filed on Aug. 6, 2014, by co-inventors Carmine Gangemi and Alberto Bevacqua, the contents of which are hereby expressly incorporated by this reference in their entirety, and to which priority is claimed.

FIELD OF USE

The present disclosure relates generally to exercise equipment. More specifically, the present disclosure relates to barbell attachment devices that provide various weight resistances on a barbell, relative to the horizontal plane of the barbell.

SUMMARY

To minimize the limitations in the prior art, and to minimize other limitations that will become apparent upon reading and understanding the present specification, the following discloses a barbell collar that provides various weight resistances in relation to the center of gravity of a barbell.

One embodiment of the present disclosure may be a barbell collar, comprising: a plate; and at least two weight bars, a first weight bar and a second weight bar; wherein the plate comprises a barbell engagement portion, a heavy arm, and a light arm; wherein the heavy arm weighs more than the light arm; wherein the barbell engagement portion is configured to engage with a barbell; wherein each of the at least two weight bars is attached to each of the at least two arm portions of the plate; and wherein the at least two weight bars are adapted to engage and hold one or more weights. The barbell engagement portion may be located approximately near a first end of the light arm and approximately near a first end of the heavy arm. The first weight bar may be located approximately near a second end of the light arm and wherein the second weight bar may be located approximately near a second end of the heavy arm. The light arm may be aligned between approximately 91 to 179 degrees from the heavy arm. The light arm may be aligned between approximately 130 to 140 degrees from the heavy arm. The light arm may be aligned between approximately 135 degrees from the heavy arm. The at least two weight bars may be substantially perpendicular to the at least two arm portions of the plate. The light arm and the heavy may be approximately the same length or be different lengths.

Another embodiment of the present disclosure may be a barbell collar, comprising: a plate; and at least two weight bars, a first weight bar and a second weight bar; wherein the plate comprises a barbell engagement portion, a heavy arm, and a light arm; wherein the heavy arm weighs more than the light arm; wherein the barbell engagement portion is configured to engage with a barbell; wherein each of the at least two weight bars is attached to each of the at least two arm portions of the plate; wherein the at least two weight bars are adapted to engage and hold one or more weights; wherein the barbell engagement portion is located approximately near a first end of the light arm and approximately near a first end of the heavy arm; wherein the first weight bar is located approximately near a second end of the light arm; wherein the second weight bar is located approximately near a second end of the heavy arm; and wherein the at least two weight bars are substantially perpendicular to the at least two arm portions of the plate. The light arm may be aligned between approximately 91 to 179 degrees from the heavy arm. The light arm may be aligned between approximately 130 to 140 degrees from the heavy arm. The light arm may be aligned between approximately 135 degrees from the heavy arm. The light arm and the heavy may be approximately the same length or they may be of different lengths.

Other features and advantages that are inherent in the barbell collar claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE ILLUSTRATIVE EMBODIMENTS

Figure 1:
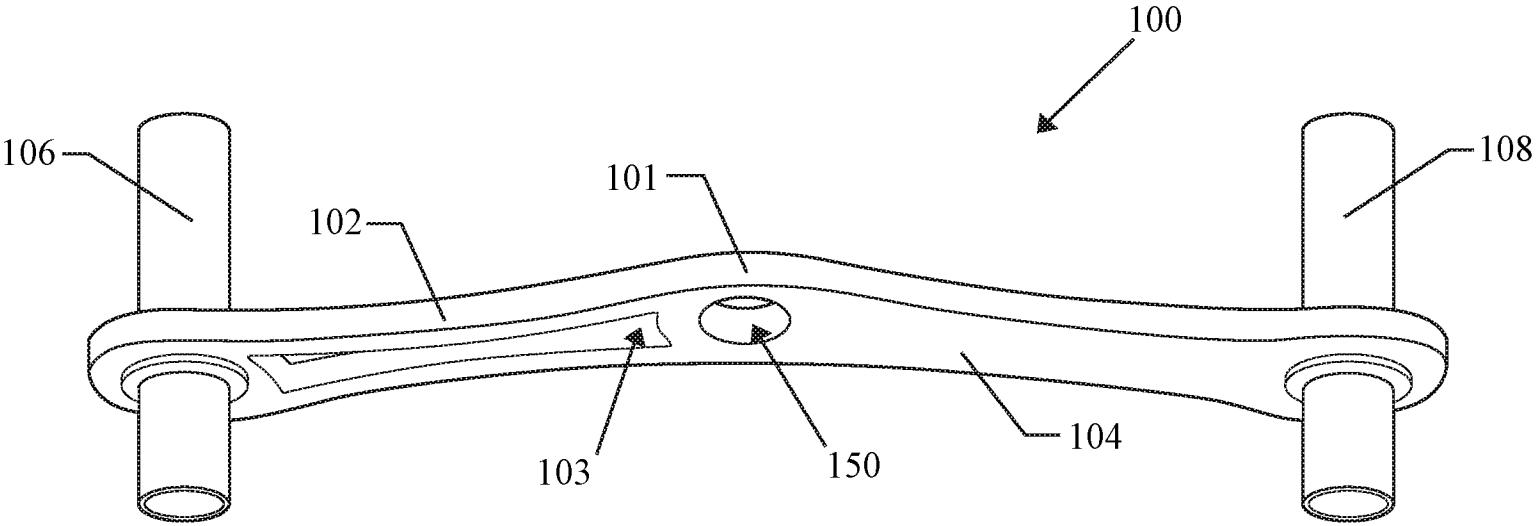
FIG. 1 is an illustration of a top perspective view of one embodiment of a barbell collar.

In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

In the following description, certain terminology is used to describe certain features of one or more embodiments. For example, the term "barbell" generally refers to any long and strong metal bar to which disks of varying weights may be attached at each end, and may be used for weightlifting. Examples of barbells may include, without limitation, standard barbells, curl bars, EZ curl bars, fixed barbells, thick-handled barbells, triceps bars, trap bars, Olympic style barbells with a 2-inch axle bearing, and/or standard barbells with a 1-inch axle bearing.

The present specification discloses a new and improved barbell collar, which may be one or more devices configured to be attached to a barbell. Specifically, the barbell collar may be generally configured to attach to the end portions of an existing barbell and may be used in pairs with respect to a single barbell. Each barbell collar may comprise at least two arm portions, wherein each arm portion may comprise a weight bar. Each weight bar may be tubular and may be configured to hold and secure one or more disc weights. In a preferred embodiment, one arm portion may be greater in mass than the other arm portion and may be angled in approximately 135° degrees from each other. The barbell collar may also be configured to rotate 360° degree around the barbell and releasable lock in various positions around the barbell.

The barbell collar may be used in several ways. The barbell collar may be utilized with only one of the arm portions loaded with disc weights. The barbell collar may be also used with the both of the arm portions loaded with disc weights. In various exercises, the amount of disc weights added to the arm portions may change. Adding and subtracting weights to the arm portions may affect the position of the barbell collar(s) as the exercise is being performed. Additionally, the user may influence the position of the arm portions in a manner, in which the user moves the actual barbell. For example, gravity may pull one arm portion down, potentially, keeping that arm portion at an approximately 90° degrees with respect to the ground's surface. However, the user may also influence the movement of the barbell by causing the barbell collar to move in an arc through various angles of free movement. The amount of weight or resistance applied to one arm portion may also influence the position of the other arm portion. Finally, the barbell collar may be used in a manner that promotes a more controlled movement of the barbell in that the user may attempt to minimize the movement of the arms through a controlled and deliberate manner of the actual barbell movement.

FIG. 1 is an illustration of a top perspective view of one embodiment of a barbell collar. As shown in FIG. 1, the barbell collar 100 may comprise: a plate 101, a first weight bar 106, and second weight bar 108. The plate 101 may comprise: a barbell engagement portion 150, light arm 102, and heavy arm 104. The plate 101 is generally constructed of any rigid material, such as metal (e.g., steel, iron, aluminum), but may be constructed of any type of material, including other metals, plastics, composites, and other man-made materials. Because the barbell collar 100 is generally used in weight-lifting, it may preferably be made of a heavy and strong metal, such as steel and/or iron. The first weight bar 106 and second weight bar 108 may be solid, or substantially tubular (hollow) (as shown), and are generally configured to receive and hold various weights, such as barbell disc weights, which are not shown, but are well known in the art. As shown, the first weight bar 106 and second weight bar 108 may be located approximately near the ends of light arm 103 and the heavy arm 104, respectively, and may be substantially perpendicular to the light arm 103 and heavy arm 104.

The barbell engagement portion 150 may be hole, as shown and may be configured to engage with and secure onto a barbell, typically an end portion of a barbell. The barbell engagement portion 150 may also include an axle-bearing (shown in FIGS. 3 and 4), which may be configured to releasably lock the barbell collar 100 into a particular lateral position with respect to the barbell. In one embodiment the collar 100 may lock onto the barbell such that the collar 100 does not rotate with respect to the barbell. In another embodiment, the barbell is configured to freely rotate with respect to the collar 100. The axel-bearing may lock onto the barbell and be freely rotatable with the collar 100 or the axel-bearing may lock onto the collar 100 and be freely rotatable with the barbell. Although the barbell engagement portion 150 may be a hole, as shown, the engagement portion 150 may be a notch, clamp, hook, grip, or the like for engaging with and being lifted by, a barbell.

The light arm 102 and heavy arm 104 may be have the same length (or substantially the same length), as preferred, or may be of different lengths. Preferably, the light arm 102 may be lighter than the heavy arm 104. FIG. 1 shows that one way to make the light arm 102 lighter than heavy arm 104, but still have both arms 102, 104 have the same length is to include a cutout 103 in the light arm 102. Another way to make the light arm 102 lighter than the heavy arm 104 is to have notches or holes cut/drilled into the light arm 102. Another way to make the light arm 102 lighter than the heavy arm 104 is to construct the lighter arm from lighter or less dense material, such as aluminum rather than iron, or to make the light arm physically thinner.

In one embodiment, the heavy arm 104 is greater in weight/mass than the light arm 102 by a 5:3 ratio.

Regarding the position and alignment between the light arm 102 and the heavy arm 104, the light arm portion 102 may be angled or aligned away from the heavy arm 104 in various degrees. For example, in an embodiment, the light arm 102 may be angled from the heavy arm 104 between 91° and 179° degrees, and may be approximately between 130° and 140° degrees. In a preferred embodiment, the light arm 102 may be angled or aligned away from the heavy arm 104 at approximately 135° degrees (shown in FIG. 2).

Figure 3:
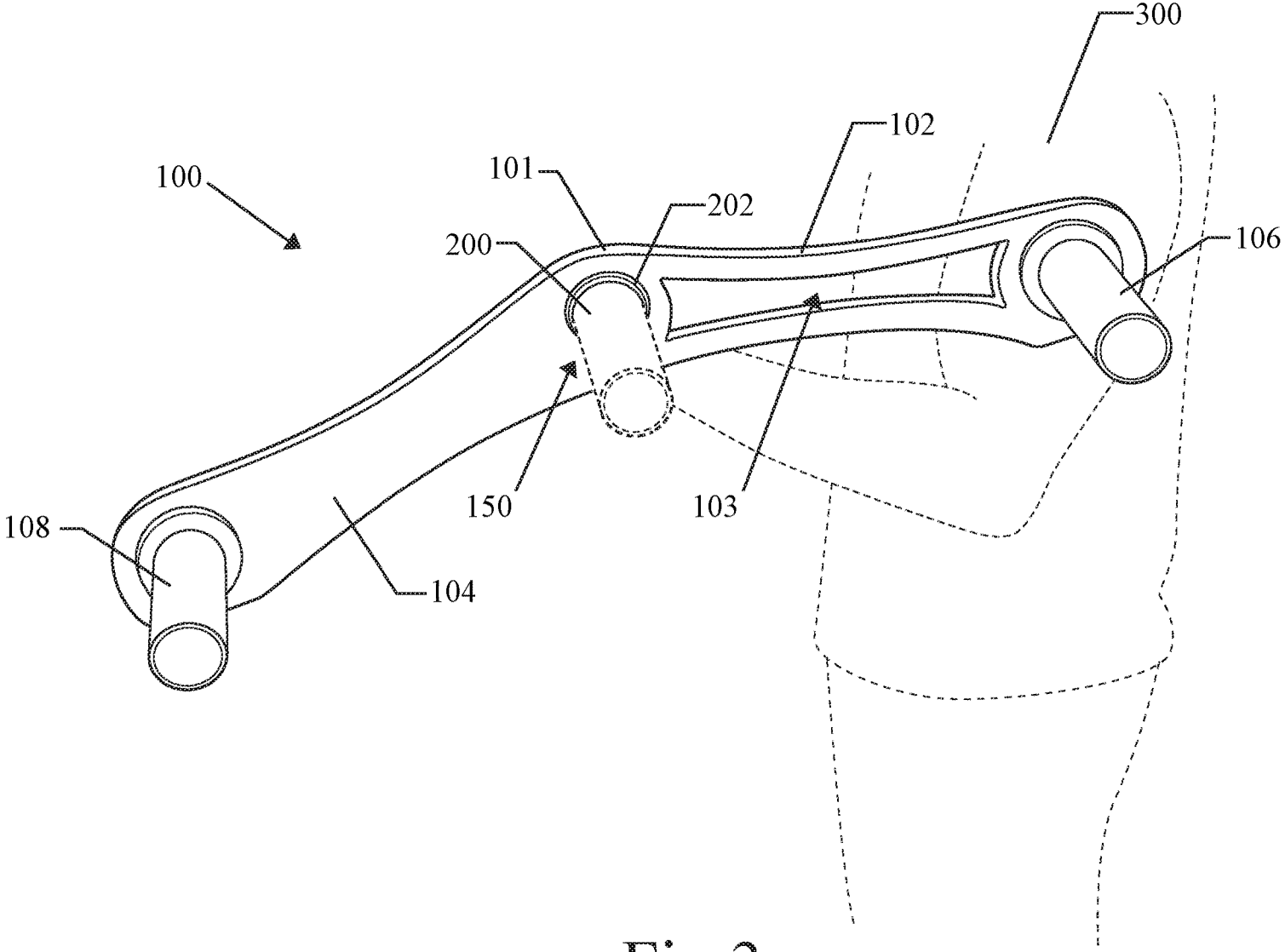
FIG. 3 is an illustration of a side view of the barbell collar on a barbell with the heavy arm configured away from a user.
Figure 4:
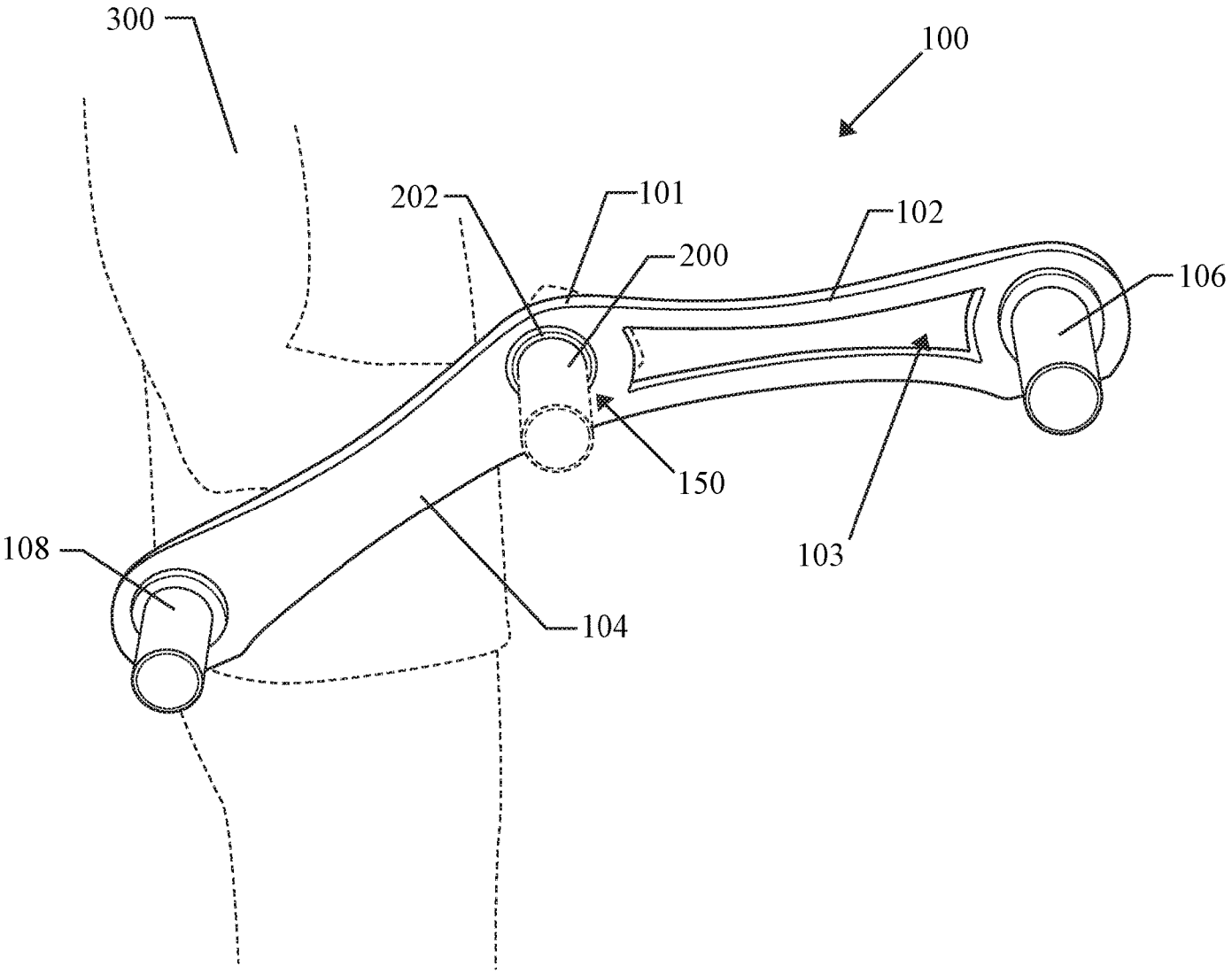
FIG. 4 is an illustration of a side view of the barbell collar on a barbell with the heavy arm configured close to a user.

During use, the barbell collar 100 may allow the user to experience various exercise positions and resistance. This is generally because the first weight bar 106 and second weight bar 108 are generally configured to freely rotate relative to the end portion on the barbell. For example, during use of the barbell collar 100, the user may face towards the concave portion of the barbell collar 100 (e.g., the 135 degree portion of the barbell collar 100 in-between the light arm 102 and heavy arm 104) (as shown in FIG. 3). Alternatively, during use of the barbell collar 100, the user may face the convex portion of the barbell collar 100 (e.g., the 225 degrees portion in-between the first arm portion 107 and second arm portion 108 of the barbell collar 100) (as shown in FIG. 4). The user may also position the barbell collars in a manner such that the user may face the concave portion of one barbell collar while, at the same time, face the convex portion of another barbell collar. As a result, the user may experience resistance through the sagittal plane, the coronal plane, the transverse plane, and the horizontal plane, or any combinations thereof.

When disc weights are not loaded onto the first weight bar 106 and second weight bar 108 of the barbell collar 100, the arms 102, 104 of the plate 101 may be positioned at various degrees relative to the barbell. For example, the light arm 102 may be positioned at an angle of approximately 90° degrees relative to the barbell's horizontal plane when the barbell and barbell collar 100 are not in contact with any surface. Additionally, the heavy arm 104 may be positioned at approximately 45° degrees relative to the barbell's horizontal plane when the barbell and barbell collar 100 are not in contact with any surface. However, various positions may be configured to the light arm 102, heavy arm 104, or combination thereof, thereby influencing the position of the arm relative to the horizontal plane of the barbell. The manner in which the barbell may move may also further influence the position of the arms relative to the horizontal plane of the barbell. The collar 100, as shown in FIG. 1, may allow the arms 102, 104 of the collar 100 to be positioned in a non-parallel manner with the horizontal plane in order to influence the perceived resistance curve of the user.

Figure 11:
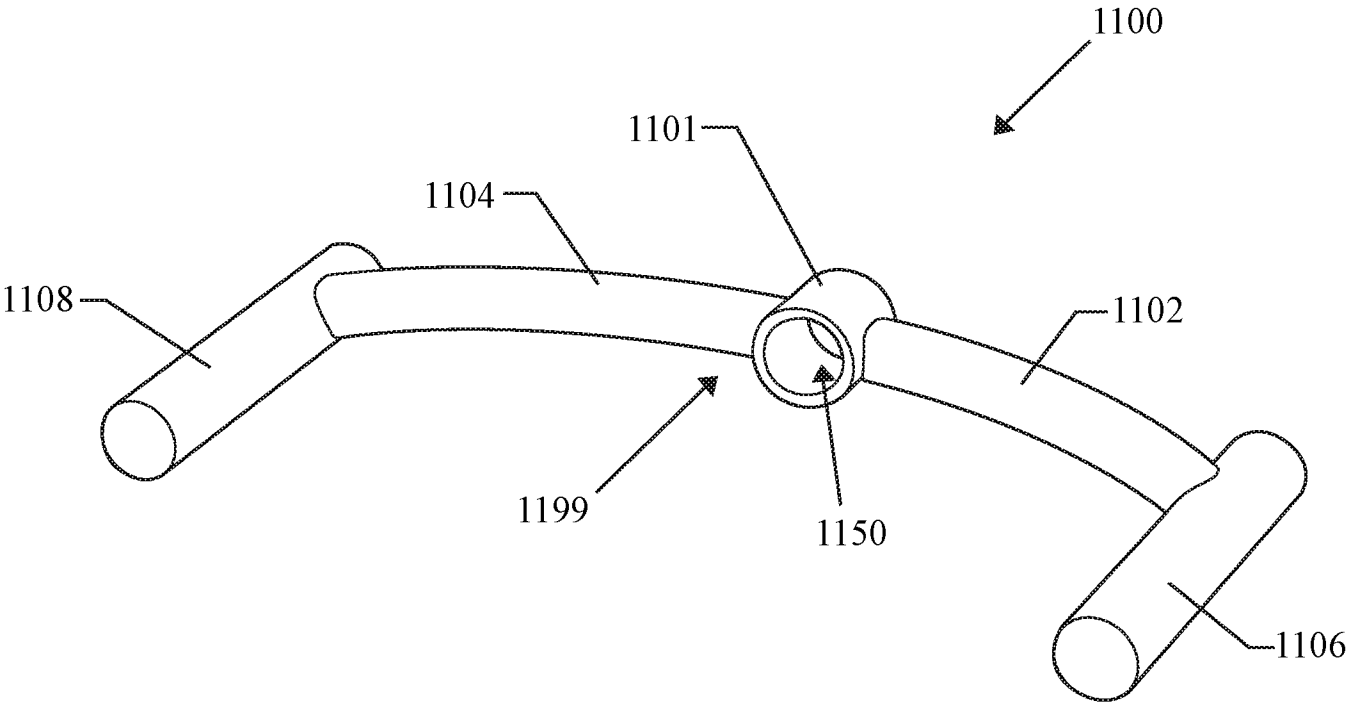
FIG. 11 is an illustration of a top perspective view of another embodiment of a barbell collar.
Figure 12:
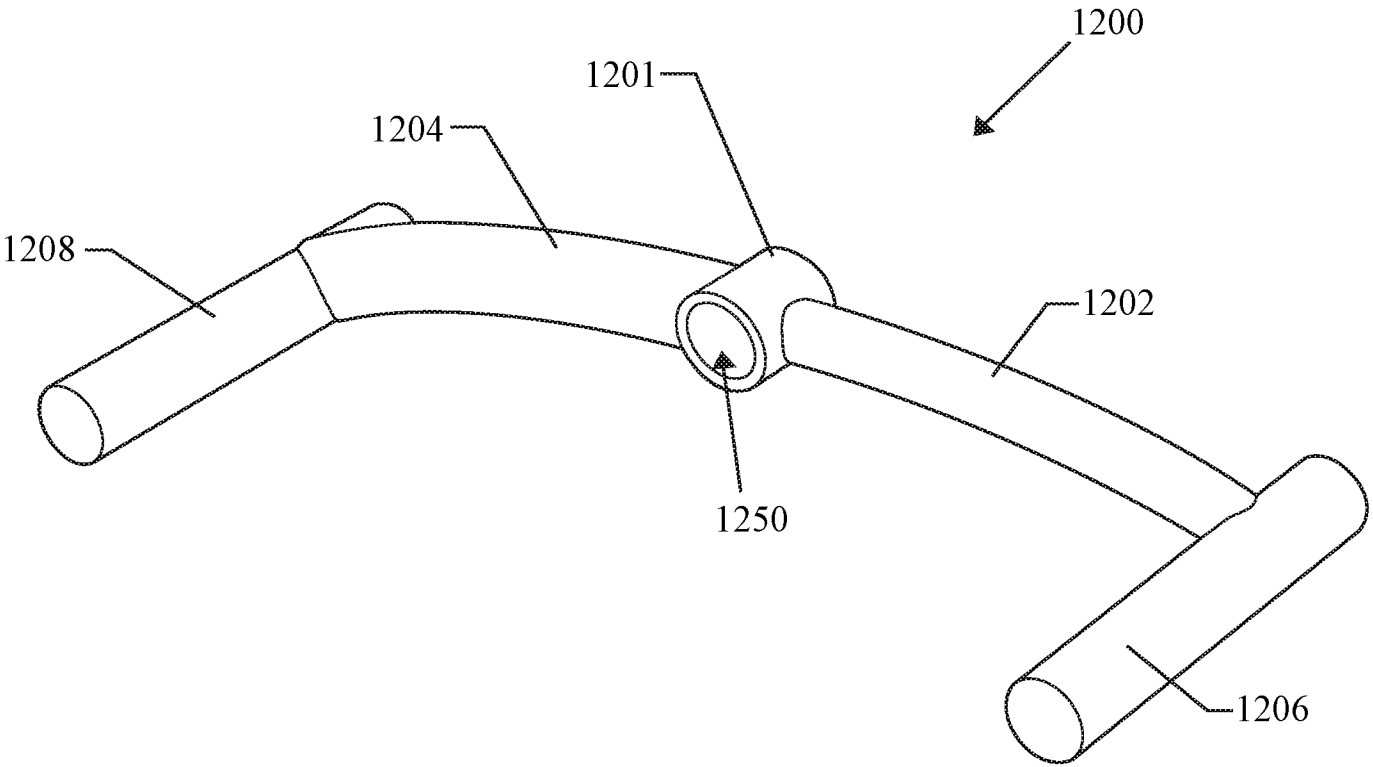
FIG. 12 is an illustration of a top perspective view of another embodiment of a barbell collar.

In some embodiments, the at least two weight bars 106, 108 may be unitary portions of the plate 101 as shown in FIGS. 11 and 12.

Figure 2:
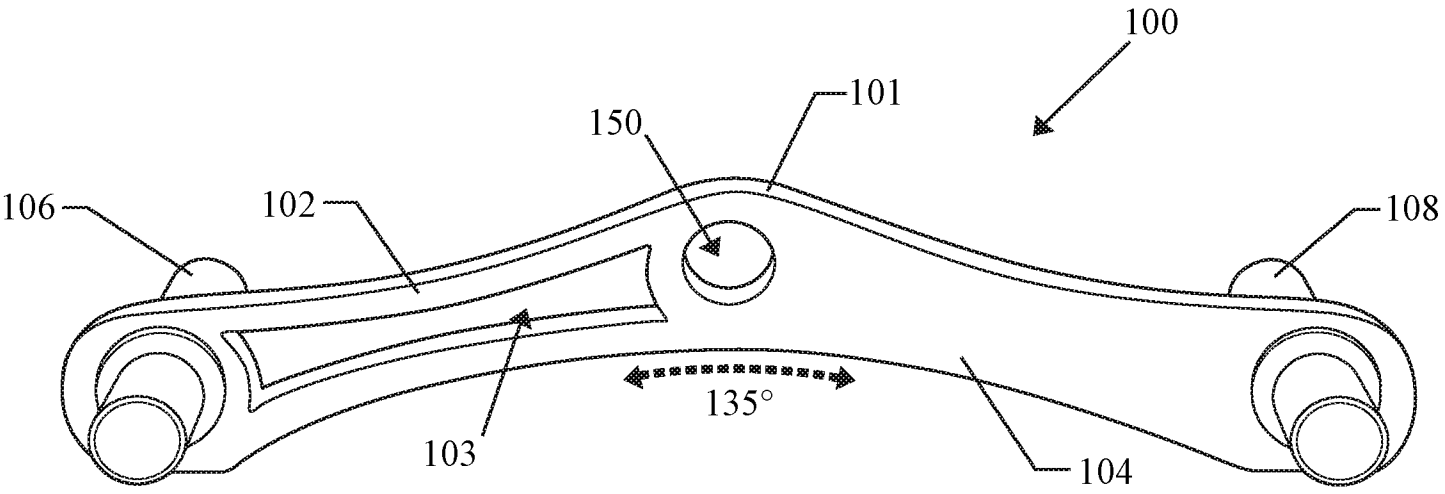
FIG. 2 is an illustration of a side view of one embodiment of the barbell collar.

FIG. 2 is an illustration of a side view of one embodiment of the barbell collar. As shown in FIG. 2, one embodiment of the barbell collar 100 may comprise: a plate 101, first weight bar 106, and second weight bar 108, wherein the plate 101 may comprise: a barbell engagement portion 150, light arm 102, and heavy arm 104. FIG. 2 shows that the light arm 102 may be lighter than the heavy arm 104 (because of cut out portion 103) and may be angled at approximately 135° degrees from the heavy arm 104. In a preferred embodiment, the light arm 102 may weigh approximately 3 units as compared to a weight of approximately 5 units for the heavy arm 104. Thus, the weight of the light arm 102 to the heavy arm 104 may be a ratio of approximately 3:5.

FIG. 3 is an illustration of a side view of the barbell collar on a barbell with the heavy arm configured away from a user. As shown in FIG. 3, one embodiment of the barbell collar 100 may comprise: a plate 101, first weight bar 106, and second weight bar 108, wherein the plate 101 may comprise: a barbell engagement portion 150 (shown in FIGS. 1 and 2), light arm 102, and heavy arm 104. FIG. 3 shows that the light arm 102 may be lighter than the heavy arm 104 (because of cut out portion 103) and may be angled at approximately 135° degrees from the heavy arm 104. FIG. 3 shows that the collar 100 is engaged with barbell 200, which is held at least laterally in place by an axle-bearing 202. FIG. 3 shows that the collar 100 may freely rotate with respect to barbell 200, and, in this configuration, the heavy arm 106, which is away from the user 300, is hanging lower than the light arm 108 and angled down, due to being heavier. In one embodiment the bearing assembly may comprise a clamping ring to secure it to the weight bar.

FIG. 4 is an illustration of a side view of the barbell collar on a barbell with the heavy arm configured close to a user. As shown in FIG. 4, one embodiment of the barbell collar 100 may comprise: a plate 101, first weight bar 106, and second weight bar 108, wherein the plate 101 may comprise: a barbell engagement portion 150 (shown in FIGS. 1 and 2), light arm 102, and heavy arm 104. FIG. 4 shows that the light arm 102 may be lighter than the heavy arm 104 (because of cut out portion 103) and may be angled at approximately 135° degrees from the heavy arm 104. FIG. 4 shows that the collar 100 is engaged with barbell 200, which is held at least laterally in place by an axle-bearing 202. FIG. 4 shows that the collar 100 may freely rotate with respect to barbell 200, and, in this configuration, the heavy arm 106, which is close to the user 300, is hanging lower than the light arm 108 and angled down, due to being heavier.

Depending on whether the user 300 does a curl as shown in FIG. 3 or FIG. 4, the user 300 will experience a different perceived resistance curve as compared to each other. The peak of the resistance curve occurs at a different angle of the movement when comparing the curl in FIG. 3 or FIG. 4. Further, the actual shape of the resistance curve (force vs angle) would be different as well.

Figure 5:
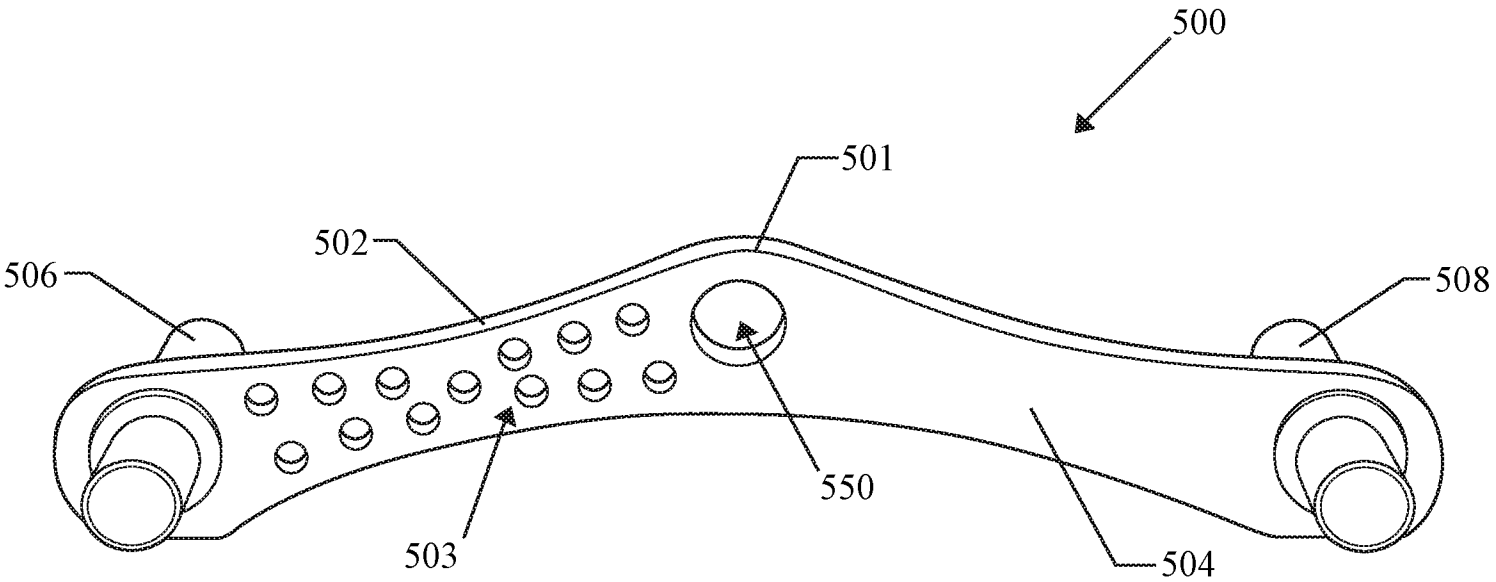
FIG. 5 is an illustration of a side view of another embodiment of the barbell collar.

FIG. 5 is an illustration of a side view of another embodiment of the barbell collar. As shown in FIG. 5, one embodiment of the barbell collar 500 may comprise: a plate 501, first weight bar 506, and second weight bar 508, wherein the plate 501 may comprise: a barbell engagement portion 550, light arm 502, and heavy arm 504. FIG. 3 shows that the light arm 502 may be lighter than the heavy arm 504 because of a plurality of holes 503 cut or drilled into light arm 502.

Figure 6:
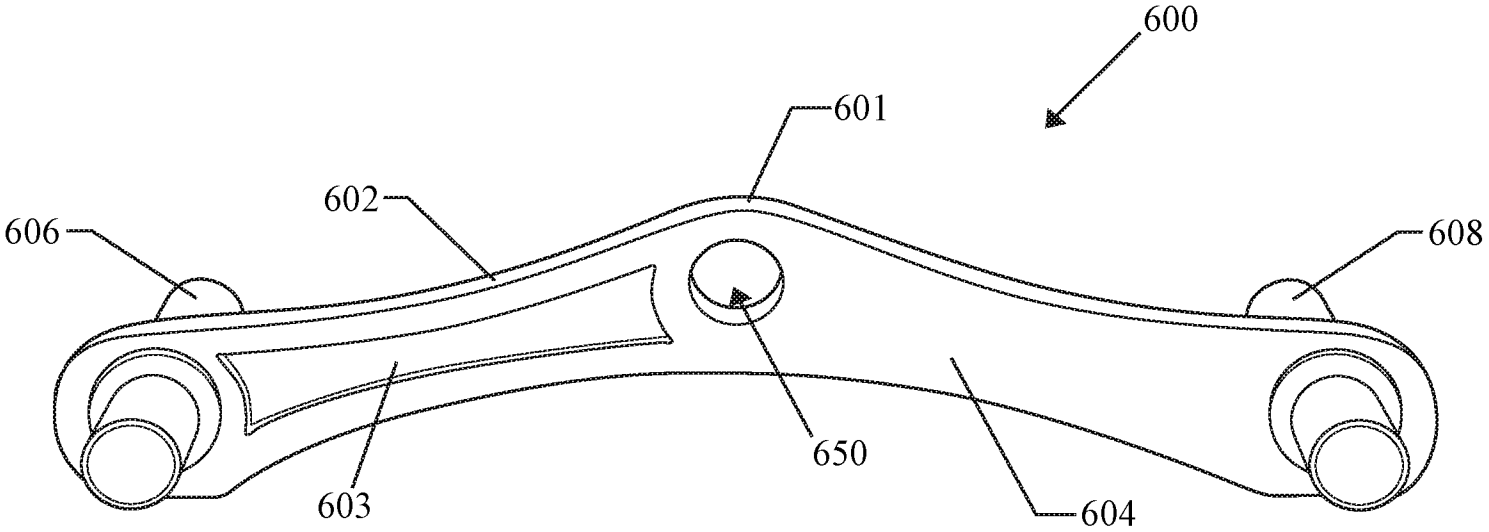
FIG. 6 is an illustration of a side view of another embodiment of the barbell collar.

FIG. 6 is an illustration of a side view of another embodiment of the barbell collar. As shown in FIG. 6, one embodiment of the barbell collar 600 may comprise: a plate 601, first weight bar 606, and second weight bar 608, wherein the plate 601 may comprise: a barbell engagement portion 650, light arm 602, and heavy arm 604. FIG. 3 shows that the light arm 602 may be lighter than the heavy arm 604 because of one or more notches or grooves 603 that are on one or both sides of light arm 602.

Figure 7:
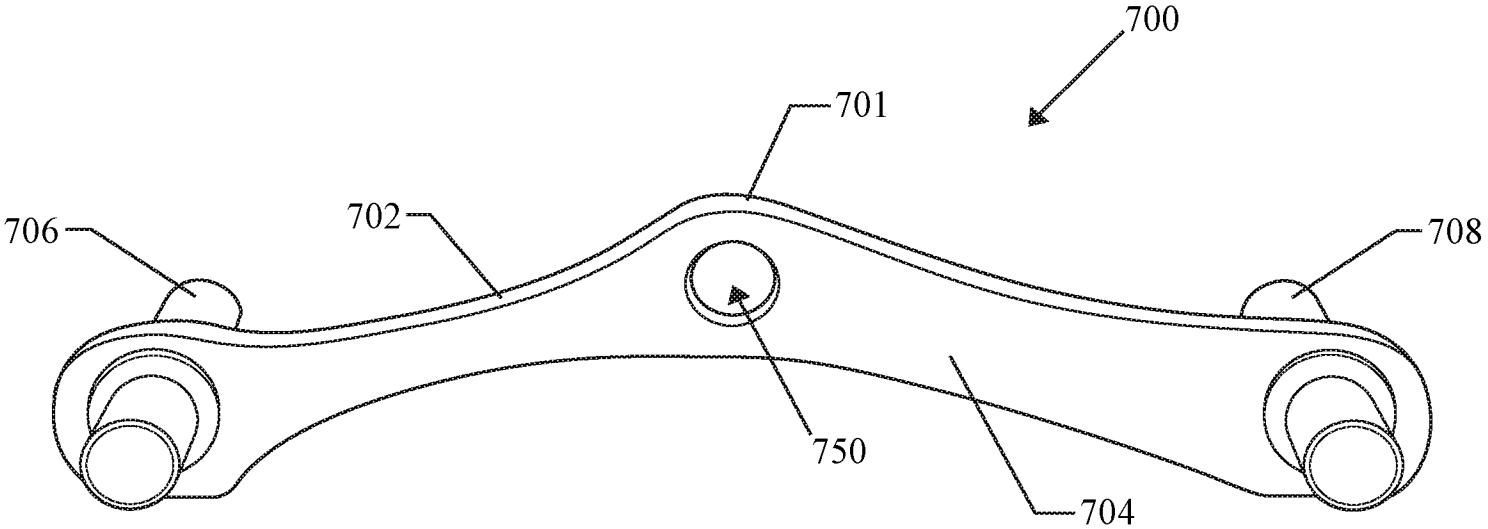
FIG. 7 is an illustration of a side view of another embodiment of the barbell collar.

FIG. 7 is an illustration of a side view of another embodiment of the barbell collar. As shown in FIG. 7, one embodiment of the barbell collar 700 may comprise: a plate 701, first weight bar 706, and second weight bar 708, wherein the plate 701 may comprise: a barbell engagement portion 750, light arm 702, and heavy arm 704. FIG. 3 shows that the light arm 702 may be lighter than the heavy arm 704 because light arm 702 is thinner and/or has less mass or less material than heavy arm 704.

Figure 8:
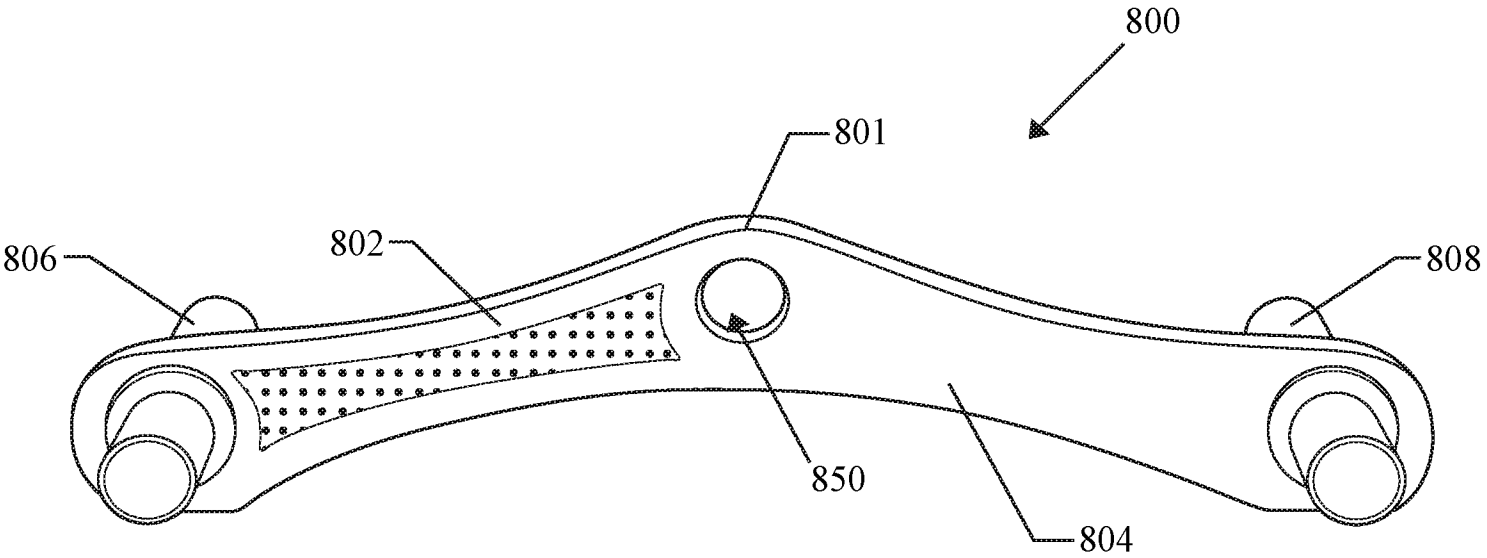
FIG. 8 is an illustration of a side view of another embodiment of the barbell collar.

FIG. 8 is an illustration of a side view of another embodiment of the barbell collar. As shown in FIG. 7, one embodiment of the barbell collar 800 may comprise: a plate 801, first weight bar 806, and second weight bar 808, wherein the plate 801 may comprise: a barbell engagement portion 850, light arm 802, and heavy arm 804. FIG. 3 shows that the light arm 802 may be lighter than the heavy arm 804 because light arm 802 is made from a material that is lighter than the material of which heavy arm 804 is constructed, or because light arm 802 is made from a less dense version of the same material of which heavy arm 804 is constructed, and is thus lighter than heavy arm 804.

Figure 9:
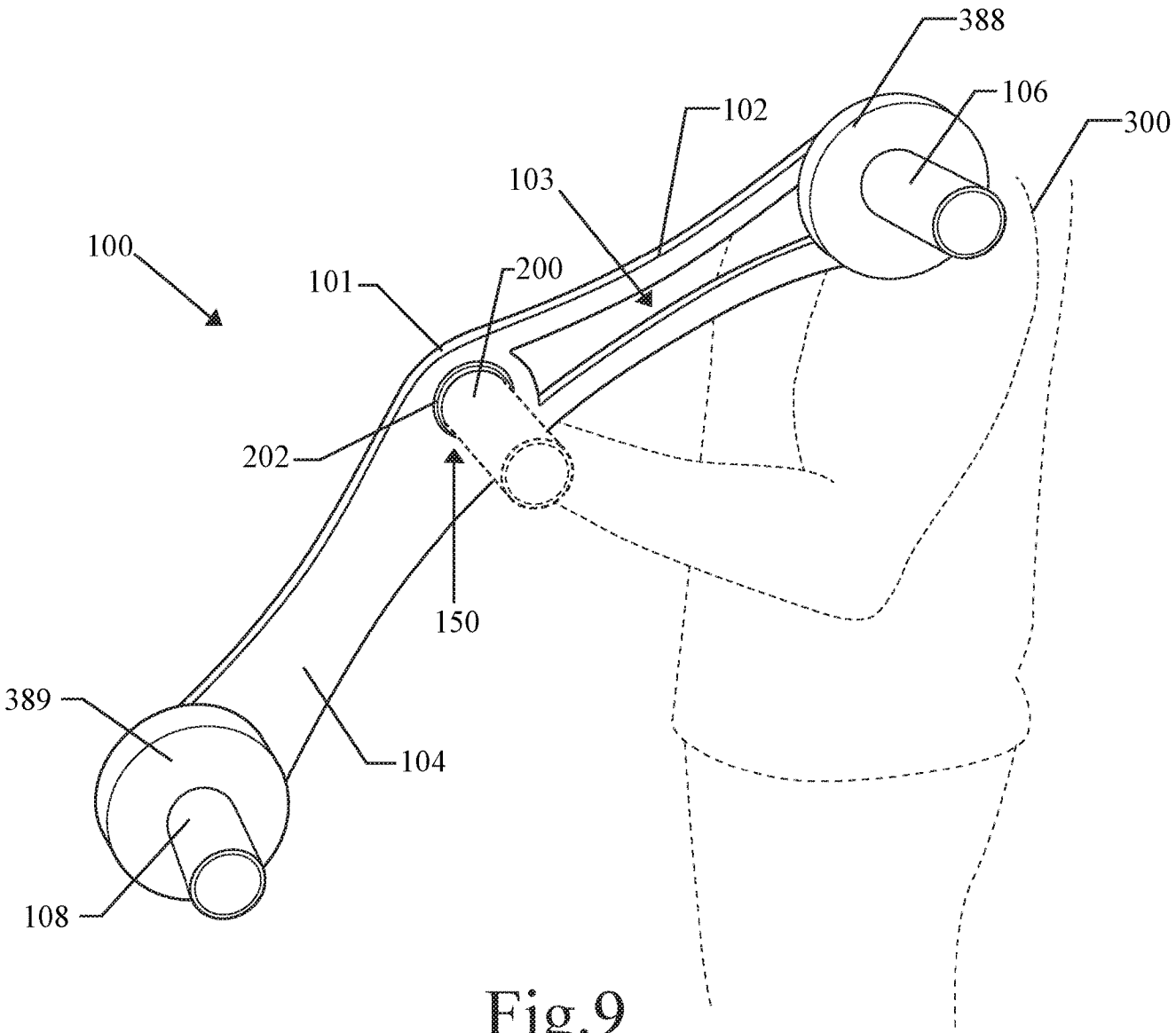
FIG. 9 is an illustration of a side view of the barbell collar on a barbell with the heavy arm configured away from a user and showing weights on the weight bars.

FIG. 9 is an illustration of a side view of the barbell collar on a barbell with the heavy arm configured away from a user and showing weights on the weight bars. As shown in FIG. 9, one embodiment of the barbell collar 100 may comprise: a plate 101, first weight bar 106, and second weight bar 108, wherein the plate 101 may comprise: a barbell engagement portion 150 (shown in FIGS. 1 and 2), light arm 102, and heavy arm 104. FIG. 9 shows that the light arm 102 may be lighter than the heavy arm 104 (because of cut out portion 103) and may be angled at approximately 135° degrees from the heavy arm 104. FIG. 9 shows that the collar 100 is engaged with barbell 200, which is held at least laterally in place by an axle-bearing 202. FIG. 9 shows that the first weight bar 106 may engage one or more weights, in this case a five (5) pound disc weight 388, and second weight bar 108 may engage one or more weights, in this case a ten (10) pound disc weight 389. As compared to the configuration in FIGS. 3 and 10, the heavy arm 108 is now hanging even lower (because the second weight bar 108 has more weight on it than the first weight bar 106), which provides the user with a different lifting experience and force curve.

Figure 10:
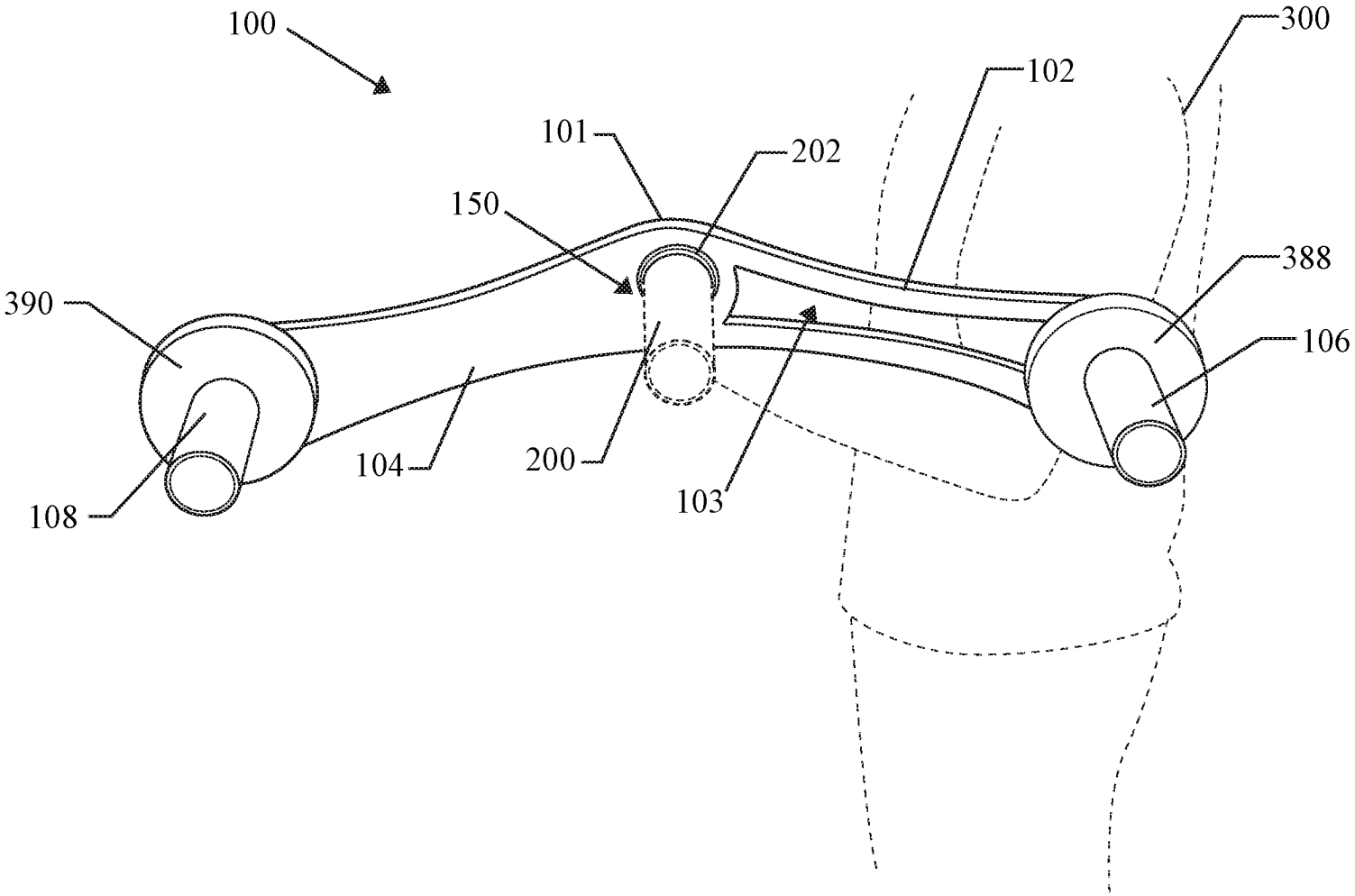
FIG. 10 is an illustration of a side view of the barbell collar on a barbell with the heavy arm configured away from a user and showing weights on the weight bars.

FIG. 10 is an illustration of a side view of the barbell collar on a barbell with the heavy arm configured away from a user and showing weights on the weight bars. As shown in FIG. 9, one embodiment of the barbell collar 100 may comprise: a plate 101, first weight bar 106, and second weight bar 108, wherein the plate 101 may comprise: a barbell engagement portion 150 (shown in FIGS. 1 and 2), light arm 102, and heavy arm 104. FIG. 9 shows that the light arm 102 may be lighter than the heavy arm 104 (because of cut out portion 103) and may be angled at approximately 135° degrees from the heavy arm 104. FIG. 9 shows that the collar 100 is engaged with barbell 200, which is held at least laterally in place by an axle-bearing 202. FIG. 9 shows that the first weight bar 106 may engage one or more weights, in this case a five (5) pound disc weight 388, and second weight bar 108 may engage one or more weights, in this case a five (5) pound disc weight 390. As compared to the configurations in FIGS. 3 and 9, this configuration provides a similar, but heavier lift than FIG. 3. Having at least two weight bars 106 and 108 allows the user to vary where to place the weights to vary the type of lift experience and force curve.

FIG. 11 is an illustration of a top perspective view of another embodiment of a barbell collar. As shown in FIG. 11, the barbell collar 1100 may comprise: a barbell engagement portion 1101, a first weight bar 1106, and second weight bar 1108, light arm 1102, and heavy arm 1104. In this embodiment the light arm 1102 and heavy arm 1104 may be of different lengths, which causes them to be of different weights. This embodiment is similar to the embodiments shown in Applicant's U.S. patent application Ser. No. 14/760,333, but in this embodiment, the light arm 102 and heavy arm 104 are of different weights. The embodiments shown in Applicant's U.S. patent application Ser. No. 14/760,333 are of different lengths, but may be the same weight or different weights.

The barbell engagement portion 1101 may comprise a hole 1150, which is configured to engage with a barbell.

The barbell collar 1100 may be generally constructed of any rigid material, such as metal (e.g., steel, iron, aluminum), but may be constructed of any type of material, including other metals, plastics, composites, and other man-made materials. FIG. 11 shows that the barbell collar 1100 may be a single unit with different portions. In other embodiments the collar 1100 may be made from several units that are permanently connected together via welding, adhesives, connectors, soldering, ultrasonic welding, and the like. Because the barbell collar 1100 is generally used in weight-lifting, it may preferably be made of a heavy and strong metal, such as steel and/or iron. The first weight bar 1106 and second weight bar 1108 may be solid, or substantially tubular (hollow), and are generally configured to receive and hold various weights, such as barbell disc weights, which are not shown, but are well known in the art. As shown, the first weight bar 1106 and second weight bar 1108 may be located approximately near the ends of light arm 1103 and the heavy arm 1104, respectively, and may be substantially perpendicular to each other.

The barbell engagement portion 1101 may be configured to engage with and secure onto a barbell, typically an end portion of a barbell, with a second collar attached to the other end of the barbell. The barbell engagement portion 1101 may also include or engage with an axle-bearing (shown in FIGS. 3 and 4), which may be configured to releasably lock the barbell collar 1100 into a particular lateral position with respect to the barbell. In one embodiment the collar 1100 may lock onto the barbell such that the collar 1100 does not rotate with respect to the barbell. In another embodiment, the barbell is configured to freely rotate with respect to the collar 1100.

The light arm 1102 and heavy arm 1104 may be have the same length (or substantially the same length), as preferred, or may be of different lengths. Preferably, the light arm 1102 may be lighter than the heavy arm 1104. FIG. 11 shows that one way to make the light arm 1102 lighter than heavy arm 1104, is to have the arms 1102, 1104 have different lengths, which means heavy arm 1104 may have more material mass and is thus, heavier. In one embodiment, the heavy arm 104 is greater in weight/mass than the light arm 102 by a 5:3 ratio, due to a greater length in a 5:3 ratio.

Regarding the position and alignment between the light arm 1102 and the heavy arm 1104, the light arm portion 102 may be angled 1199 or aligned away from the heavy arm 1104 in various degrees. For example, in an embodiment, the light arm 1102 may be angled from the heavy arm 1104 between 91° and 179° degrees, and may be approximately between 130° and 140° degrees. In a preferred embodiment, the light arm 1102 may be angled or aligned away from the heavy arm 1104 at approximately 135° degrees (shown in FIG. 2).

During use, the barbell collar 1100 may allow the user to experience various exercise positions and resistance. This is generally because the first weight bar 1106 and second weight bar 1108 are generally configured to freely rotate relative to the end portion on the barbell. For example, during use of the barbell collar 1100, the user may face towards the concave portion of the barbell collar 1100 (e.g., the 135 degree portion of the barbell collar 1100 in-between the light arm 1102 and heavy arm 1104) (as shown in FIG. 3). Alternatively, during use of the barbell collar 1100, the user may face the convex portion of the barbell collar 1100 (e.g., the 225 degrees portion in-between the first arm portion 1107 and second arm portion 1108 of the barbell collar 1100) (as shown in FIG. 4). The user may also position the barbell collars in a manner such that the user may face the concave portion of one barbell collar while, at the same time, face the convex portion of another barbell collar. As a result, the user may experience resistance through the sagittal plane, the coronal plane, the transverse plane, and the horizontal plane, or any combinations thereof.

When disc weights are not loaded onto the first weight bar 1106 and second weight bar 1108 of the barbell collar 1100, the arms 1102, 1104 of the collar 1100 may be positioned at various degrees relative to the barbell. For example, the light arm 1102 may be positioned at an angle of approximately 90° degrees relative to the barbell's horizontal plane when the barbell and barbell collar 1100 are not in contact with any surface. Additionally, the heavy arm 1104 may be positioned at approximately 45° degrees relative to the barbell's horizontal plane when the barbell and barbell collar 1100 are not in contact with any surface. However, various positions may be configured to the light arm 1102, heavy arm 1104, or combination thereof, thereby influencing the position of the arm relative to the horizontal plane of the barbell. The manner in which the barbell may move may also further influence the position of the arms relative to the horizontal plane of the barbell. The collar 1100, as shown in FIG. 11, may allow the arms 1102, 1104 of the collar 1100 to be positioned in a non-parallel manner with the horizontal plane in order to influence the perceived resistance curve of the user.

FIG. 12 is an illustration of a top perspective view of another embodiment of a barbell collar. As shown in FIG. 12, the barbell collar 1200 may comprise: a barbell engagement portion 1201, a first weight bar 1206, and second weight bar 1208, light arm 1202, and heavy arm 1204. In this embodiment the light arm 1202 and heavy arm 1204 may be of different diameters, which causes them to be of different weights. Heavy arm 1204, as shown, may be thicker and thus greater in diameter than the light arm 1202, which causes the heavy arm 1204 to be greater in mass or weight. Although the arms 1202, 1204 are shown having the same length, they do not have to be of the same or substantially the same length. In some embodiments the arms 1202, 1204 are different lengths, as shown in FIG. 12. The barbell engagement portion 1201 may comprise a hole 1250, which is configured to engage with a barbell.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. This disclosure should therefore not be limited by the above described embodiment, method, and examples, but by all embodiments and methods within the scope and spirit of the disclosure as claimed.

The foregoing description of the preferred embodiment has been presented for the purposes of illustration and description. While multiple embodiments are disclosed, still other embodiments will become apparent to those skilled in the art from the above detailed description, which shows and describes illustrative embodiments. As will be realized, the embodiments are capable of modifications in various obvious aspects, all without departing from the spirit and scope. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope. It is intended that the scope not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A barbell collar, comprising: a plate;

wherein said plate comprises a barbell engagement portion, and at least two arm portions; wherein said two arm portions comprise a heavy arm and a light arm;

wherein said heavy arm weighs more than said light arm; and wherein said at least two arm portions of said plate each comprise a weight bar, such that there are two weight bars, a first weight bar and a second weight bar.

2. The barbell collar of claim 1, wherein said at least two weight bars are removeable from said at least two arm portions of said plate.

3. The barbell collar of claim 1, wherein said at least two weight bars are not removeable from said at least two arm portions of said plate.

4. The barbell collar of claim 1, wherein said barbell engagement portion is an enclosed hole that is configured to engage with a barbell.

5. The barbell collar of claim 1, wherein said barbell engagement portion is configured to engage with a barbell and is not an enclosed hole.

6. The barbell collar of claim 1, wherein each of said at least two weight bars is configured to engage with one or more weights.

7. The barbell collar of claim 6, wherein said at least two weight bars are substantially perpendicular to said at least two arm portions of said plate and are substantially parallel to each other.

8. The barbell collar of claim 1, wherein said barbell engagement portion is located approximately near a first end of said light arm and approximately near a first end of said heavy arm;

wherein said first weight bar is located approximately near a second end of said light arm;

wherein said second weight bar is located approximately near a second end of said heavy arm.

9. The barbell collar of claim 8, wherein said light arm is aligned between approximately 91 to 179 degrees from said heavy arm.

10. The barbell collar of claim 9, wherein said light arm is aligned between approximately 130 to 140 degrees from said heavy arm.

11. The barbell collar of claim 10, wherein said light arm is aligned approximately 135 degrees from said heavy arm.

12. The barbell collar of claim 1, wherein said light arm and said heavy are not the same length.

13. The barbell collar of claim 1, wherein said light arm and said heavy are approximately the same length.

* * * * *